US008113236B2

(12) United States Patent
Kandiyeli et al.

(10) Patent No.: US 8,113,236 B2
(45) Date of Patent: Feb. 14, 2012

(54) SYSTEM AND METHOD FOR DELIVERING CHEMICALS

(75) Inventors: David Kandiyeli, Mesa, AZ (US); Todd Graves, Winder, GA (US); Rhey Yang, Jhubei (TW)

(73) Assignee: Mega Fluid Systems, Inc., Tualatin, OR (US)

( * ) Notice: Subject to any disclaimer, the term of this patent is extended or adjusted under 35 U.S.C. 154(b) by 1183 days.

(21) Appl. No.: 11/778,809

(22) Filed: Jul. 17, 2007

(65) Prior Publication Data

US 2008/0012157 A1 Jan. 17, 2008

Related U.S. Application Data

(60) Provisional application No. 60/831,335, filed on Jul. 17, 2006.

(51) Int. Cl.
*B05D 1/00* (2006.01)

(52) U.S. Cl. ..... 137/563; 427/345; 222/318; 239/124

(58) Field of Classification Search ..... 137/563; 222/318; 239/124, 127; 427/345
See application file for complete search history.

(56) References Cited

U.S. PATENT DOCUMENTS 2,022,481 A * 11/1935 Schellenger ..... 137/563
2,244,686 A * 6/1941 Garrison et al. ..... 239/76
5,309,403 A * 5/1994 Bartow ..... 366/136
5,791,376 A 8/1998 Richmond
6,406,519 B1 6/2002 Tom et al.
6,457,852 B1 10/2002 Hiraoka et al.
6,471,750 B1 10/2002 Olander
6,536,468 B1 3/2003 Wilmer et al.
6,910,954 B2 * 6/2005 Kim et al. ..... 451/60
6,955,198 B2 10/2005 Wodjenski
6,997,202 B2 2/2006 Olander
7,007,822 B2 3/2006 Forshey et al.
7,018,448 B2 3/2006 Wodjenski et al.
7,051,749 B2 5/2006 Wodjenski et al.
7,066,191 B2 6/2006 Graves et al.
7,363,114 B2 * 4/2008 Anderson et al. ..... 700/285
2001/0047821 A1 12/2001 Noji
2002/0186613 A1 12/2002 Hiraoka et al.
2004/0144736 A1 7/2004 Yajima

* cited by examiner

*Primary Examiner* — Stephen M Hepperle
*Assistant Examiner* — Atif Chaudry
(74) *Attorney, Agent, or Firm* — Scheinberg & Griner, LLP; David Griner; Robert Amedeo

(57) ABSTRACT

Systems and method for delivering materials to a tool are disclosed. A material delivery system utilizes two or more sources of the material to be delivered to the tool. One or more of the sources of the tool may be a batch mixer. The material delivery system also includes at least two material delivery recirculation lines providing material to at tool. The material delivery system may be manually or automatically controlled to switch supply of the material from one source to another, and/or to switch from one material delivery recirculation line to another.

9 Claims, 2 Drawing Sheets

SYSTEM AND METHOD FOR DELIVERING CHEMICALS

This application claims priority under 35 U.S.C. §119(e) to U.S. Provisional Application Ser. No. 60/831,335 filed on Jul. 17, 2006, entitled SYSTEM AND METHOD FOR DELIVERING CHEMICALS, which is herein incorporated by reference in its entirety for all purposes.

BACKGROUND OF INVENTION

1. Field of Invention

The present invention relates to a system and method for delivering chemicals to a tool and, more particularly, to a chemical delivery system and method utilizing at least two sources of the chemical.

2. Discussion of Related Art

Chemical delivery systems are used, for example, in the semiconductor pharmaceutical, and cosmetic industries. Semiconductor manufacturing typically utilizes chemical distribution systems to deliver chemicals to a process tool. In particular, slurry distribution systems deliver a slurry for chemical mechanical polishing (CMP). Oftentimes, it is desirable to provide a precise flow rate of the chemical or slurry to the process tool. Flow meters which may be susceptible to changes in input pressure are commonly used to deliver slurries and chemicals to the tool.

Chemical delivery systems commonly include duplicate sources of chemical, in order to avoid down time. Changes in input pressure to the process tool may occur when switching delivery of a chemical from one supply source, typically a mixing tank, to another. Even minor fluctuations in process parameters associated with such transitioning, however, may lead to a significant disruption of the continuous delivery of the chemical and/or quality of the process or product. When an in-service mixing tank goes off-line, there may also be low or residual chemical present in the tank which may cause a pressure drop in the supply line to the process tool. In addition, residual chemical in the tank typically represents waste with an associated cost. In addition to the loss of residual chemical in the tank, there may be significant dead leg loss with chemicals remaining in now off-line process piping.

U.S. Pat. No. 7,007,822 to Forshey, et al, discloses a chemical mix and delivery system. In Forshey, a mixing tank is also a main reservoir of chemical to be delivered to a tool. One or more buffer reservoirs are positioned downstream of the main reservoir for delivery to a tool. A programmable loop controller controls the pressure in each buffer reservoir to achieve a desired flow rate of CMP slurry from the buffer reservoirs. To clean and/or flush the main reservoir, the controller interrupts flow to the buffer reservoirs while DI water is added to the main reservoir and sent to a drain. The process tool determines from which of two buffer reservoirs the chemical slurry will be drawn.

SUMMARY OF INVENTION

One embodiment of the invention is directed to a method of providing a material to a semiconductor tool comprising passing a first material through a first recirculation line fluidly connected to a tool and delivering a first portion of the first material from the first recirculation line to the tool. The first material is also passed through a second recirculation line fluidly connected to the tool.

According to another embodiment, a material delivery system comprises a first recirculation line fluidly connected to a tool, a second recirculation line fluidly connected to the tool, a first source of material fluidly connected to the first recirculation line and the second recirculation line upstream of the tool, and a second source of material fluidly connected to the first recirculation line and the second recirculation line upstream of the tool. A controller, responsive to at least one of a predetermined quantity of material from the first source of material, a predetermined quantity of material from the second source of material, and duration of in-service operation of at least one of the first recirculation line and the second recirculation line, is configured to provide a substantially constant flow of material in at least one of the first recirculation line and the second recirculation line.

In yet another embodiment, a material delivery system comprises a first recirculation line fluidly connected to a tool, a second recirculation line fluidly connected to the tool, a first source of material fluidly connected to the first recirculation line and the second recirculation line upstream of the tool, and a second source of the material fluidly connected to the first recirculation line and the second recirculation line upstream of the tool. The system also includes means for passing the material from at least one of the first source of material and the second source of material to at least one of the first recirculation line and the second recirculation line, and means for purging at least one of the first recirculation line and the second recirculation line.

Other advantages, novel features and objects of the invention will become apparent from the following detailed description of the invention when considered in conjunction with the accompanying drawings.

BRIEF DESCRIPTION OF DRAWINGS

The accompanying drawings are not intended to be drawn to scale. In the drawings, each identical or nearly identical component that is illustrated in various figures is represented by a like numeral. For purposes of clarity, not every component is labeled in every figure, nor is every component of each embodiment of the invention shown where illustration is not necessary to allow those of ordinary skill in the art to understand the invention. In the drawings.

DETAILED DESCRIPTION

Figure 1:
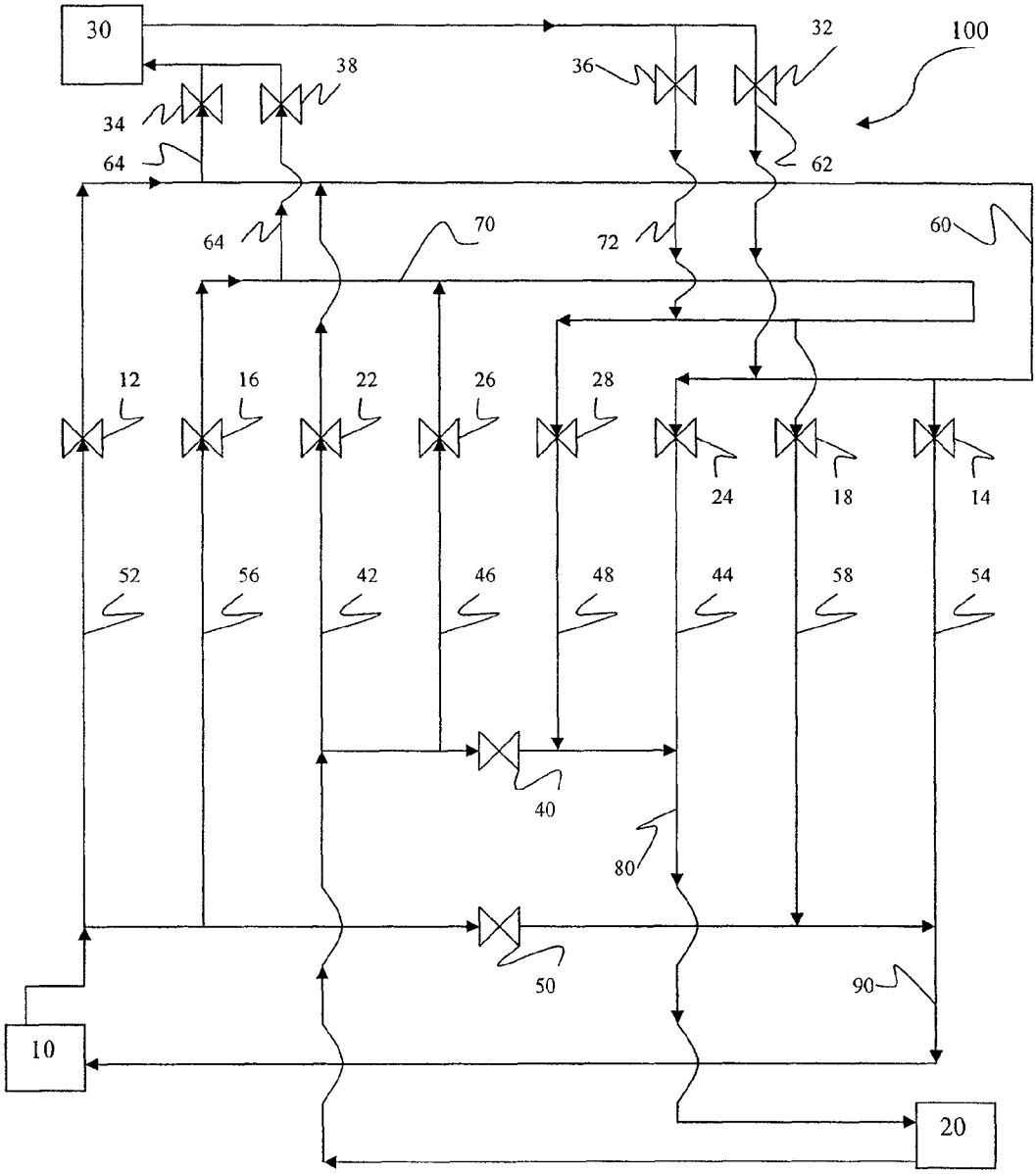
FIG. 1 is a schematic diagram illustrating a system in accordance with an embodiment of the present invention.

This invention is not limited in its application to the details of construction and the arrangement of components set forth in the following description or illustrated in the drawings. The invention is capable of other embodiments and of being practiced or of being carried out in various ways. Also, the phraseology and terminology used herein is for the purpose of description and should not be regarded as limiting. The use of "including," "comprising," or "having," "containing," "involving," and variations thereof herein, is meant to encompass the items listed thereafter and equivalents thereof as well as additional items.

In accordance with one or more embodiments, the present invention relates generally to one or more systems and methods for providing material to a tool. As used herein, the term "material" includes any liquid, such as a solvent, gas, chemicals, and slurries. As used herein, the term "tool" is defined as a point of use for the material, and includes, but is not limited to, an individual unit or series of units. For example, a tool may include one or more semiconductor fabrication lines.

The systems and methods described herein may be used, for example, in continuously delivering materials with applications in a wide variety of industries including the cosmetic, pharmaceutical and semiconductor industries, as well as others in which there may be demand for a continuous and/or accurate supply of materials.

Embodiments of the present invention may generally provide material to a tool utilizing two or more sources of the material to be provided to minimize or eliminate tool down time. The material may be provided from any source, suitable for a desired application, such as a vessel. Any vessel, such as a holding vessel and/or a batch mixing vessel of any size and shape may be used. The two or more sources of material may, but need not, be identical. In one embodiment, material may be provided from mixing tanks having at least one inlet and outlet and a tank recirculation line. Examples of mixing tanks which may be used are described in U.S. Pat. Nos. 6,109,778 and 6,536,468, incorporated herein by reference for all purposes.

In one embodiment, means is provided to pass the material from two or more sources to one or more supply lines and to switch delivery of material between and among the two or more sources. For example, a manifold and/or one or more valves may be suitably positioned to divert material from a tank to a tool supply line. In one embodiment, one or more valves may be positioned on a tank recirculation line to divert material from the tank to the tool and/or to isolate the tank from the tool when the material in the tank is below a predetermined level or the tank is to be cleaned or otherwise serviced. Operation of the valves to switch between a first tank and a second tank need not be sequential. That is to say, a first low level tank may continue to drain and feed a tool supply line in addition to the second tank more recently brought on line. The first tank may subsequently be isolated from the tool supply line when a second lower level of material is reached in the first tank or the first tank is empty. In some embodiments, switching between tanks may occur weekly, daily, or hourly, at intermittent or periodic intervals.

One or more valves may be controlled manually or automatically in response to one or more sensors. In one embodiment, as an example, the valves may automatically respond to a signal originating from a sensor which may detect a level of material present in the tank, a pressure, a flow rate, or another characteristic of the material. The signal may be any suitable signal, such as, a pneumatic signal, a mechanical signal, an electrical signal, or the like. The sensor may be located in any appropriate position for a particular purpose, such as, in a vessel containing the material and/or in any process line including a material supply line. The sensor may be any sensor suitable for a desired application. For example, the sensor may be a liquid level sensor, a concentration sensor, and combinations thereof. Concentration sensors may be based on one or more of density, refractive index, conductance, spectroscopic measurements, and ultrasonic wave emitting devices. The valve(s) may be any check valve, a gate valve, a diaphragm valve, a globe valve, a butterfly valve, pinch valve, or the like. In response to the signal, the valve may respond by fully opening and closing in some embodiments, or by partially opening and closing in other embodiments.

In one embodiment, the material delivery system includes two or more material supply lines fluidly connected to one or more tools and fluidly connected to two or more sources of material. The material supply lines may be material recirculation lines or loops, from which a first portion of the material is diverted to the tool and a second portion of the material is recirculated back to its source or to another source of the material. In another embodiment, means may be provided to switch supplying one material recirculation line to supplying another. For example, suitably positioned one or more manifolds and/or valves may isolate a first material recirculation line and initiate material flow to a second recirculation line. The valves may be manually or automatically controlled in response to one or more sensors, as noted above. The presence of two or more material recirculation lines that are able to provide material to a tool allows for continuous delivery of material to the tool, even when one of the material recirculation lines is off-line for service or scheduled maintenance.

In one embodiment, the one or more valves may be controlled in response to a predetermined period of in-service operation of a material recirculation line. A material recirculation line or loop may be regularly or periodically scheduled for flushing and or cleaning and taken out of service. The material recirculation line may be taken out of service yearly, monthly, or weekly. The material recirculation line or lines may be flushed with any suitable gas, chemical, solvent, and combinations thereof, that is compatible with the material delivery system. Examples of suitable flushing material include, but are not limited to, deionized water, potassium hydroxide (KOH) solution, and nitrogen.

Flushing and cleaning of the material recirculation line provided to the tool may occur in one or more steps. For example, a material recirculation line containing a slurry may first be flushed with deionized water which may be recirculated or sent to a drain, followed by a flush with KOH, which may be recirculated and/or sent to a drain. A final flush may include passing a suitable gas through the material recirculation line. Suitable gases include any gas compatible with the process piping and preferably include those which leave no or little residue within the process piping. In one embodiment, an inert gas, such as nitrogen, may be used as a final flush of the material recirculation line. The flushed material recirculation line may remain in standby mode, ready to take the place of another recirculation line to be brought out-of-service. Multi-step flushing of the material recirculation line may occur while the in-service material recirculation line continuously provides material to the tool by switching between two or more sources of material. A multi-step flush of different flushing material may occur in any order appropriate for a particular purpose.

Operation of at least one embodiment of the present invention will now be described in greater detail with reference to the accompanying drawings.

FIG. 1 shows a material delivery system according to one embodiment of the present invention. The material delivery system 100 includes a first source of material in a mixing tank 10 and a second source of the material in a mixing tank 20. The material delivery system 100 also includes a first material recirculation line 60 fluidly connected to the first tank 10 and the second tank 20. The first material recirculation line is also fluidly connected to a tool (not shown) to deliver material to the tool. A second material recirculation line 70 is also fluidly connected to the tool (not shown) and the first tank 10 and the second tank 20. Material delivery system 100 may also include a source of a second material 30 fluidly connected to the first material recirculation line 60 and the second material recirculation line 70 for flushing and/or cleaning an out-of-service material recirculation line.

In FIG. 1, the positioning of a number of valves defines various configurations of flow. For the purpose of describing flow paths, each path will be individually described with either one or two open valves, while all other valves are closed. However, it is understood that more than one flow path may be simultaneously open.

Valve 50 is disposed in tank recirculation line 90 fluidly connected to first tank 10, and valve 40 is disposed in tank recirculation line 80 fluidly connected to second tank 20. When valves 40 and 50 are open and all other valves closed, material from tanks 10 and 20 is recirculated back to its respective tank.

In FIG. 1, tank 10 is fluidly connected to material recirculation line 60. Valve 12 is positioned on line 52 fluidly connected to material recirculation line 60 and to tank 10 via a segment of tank recirculation line 90 upstream of valve 50. Valve 14 is positioned on line 54 fluidly connected to material recirculation line 60 and tank 10 via a segment of tank recirculation line 90 downstream of valve 50. When valve 12 and valve 14 are open and all other valves are closed, material passes from tank 10 through material recirculation line 60, where a portion of material may be supplied to the tool and another portion may be returned to tank 10 via a segment of tank recirculation line 90.

Tank 10 is also fluidly connected to material recirculation line 70. Valve 16 is positioned on line 56 fluidly connected to material recirculation line 70 and to tank recirculation line 90 upstream of valve 50. Valve 18 is positioned on line 58 fluidly connected to material recirculation line 70 and to a segment of tank recirculation line 90 downstream of valve 50. When valves 16 and 18 are open and all other valves are closed, material passes from tank 10 through material recirculation line 70, where a portion of material may be supplied to the tool and another portion may be returned to tank 10 via a segment of recirculation line 90.

Tank 20 of material delivery system 100 is also fluidly connected to material recirculation lines 60 and 70 as shown in FIG. 1. Valve 22 is positioned on line 42 fluidly connected to material recirculation line 60 and to tank 20 via a segment of tank recirculation line 80 upstream of valve 40. Valve 24 is positioned on line 44 fluidly connected to material recirculation line 60 and to tank 20 via a segment of tank recirculation line 80 downstream of valve 40. When valves 22 and 24 are open and all other valves closed, material passes from tank 20 through material recirculation line 60, where a portion of material may be supplied to the tool and another portion may be returned to tank 20 via a segment of tank recirculation line 80.

Valve 26 is positioned on line 46 fluidly connected to material recirculation line 70 and to tank 20 via a segment of tank recirculation line 80 upstream of valve 40. Valve 28 is positioned on line 48 fluidly connected to material recirculation line 70 and to tank 20 via a segment of tank recirculation line 80 downstream of valve 40. When valves 26 and 28 are open and all other valves are closed, material passes from tank 20 through material recirculation line 70, where a portion of material may be supplied to the tool and a another portion may be returned to tank 20 via a segment of tank recirculation line 80.

Material recirculation lines 60 and 70 may be fluidly connected to a source of a second material used for flushing and/or cleaning the material recirculation lines. As shown in FIG. 1, tank 30 containing a second material is fluidly connected to material recirculation line 60 via valve 32 positioned on line 62 and valve 34 positioned on line 64. When valves 32 and 34 are open and all other valves are closed, the second material passes through material recirculation line 60. As shown in FIG. 1, the second material may be recirculated back into tank 30 for subsequent draining. Alternatively, the second material exiting material recirculation line 60 via valve 34 may be diverted directly to a drain (not shown). FIG. 1 shows positioning of lines 62 and 64 to provide a direction of flow of the second material counter to a direction of flow of the material to the tool, although it is envisioned that lines 62 and 64 may be positioned to provide the same direction of flow for both materials.

Tank 30 is also fluidly connected to material recirculation line 70 via valve 36 positioned on line 72 and valve 38 positioned on line 74. When valves 36 and 38 are open, and all other valves are closed, the second material passes through material recirculation line 70. As shown in FIG. 1, the second material may be recirculated back to tank 30 for subsequent draining. Alternatively, the second material exiting material recirculation line 70 via valve 38 may be diverted directly to a drain (not shown). As with material recirculation line 60, the direction of flow of the second material through material recirculation line 70 may be counter to or in the same direction as flow of the material being delivered to the tool.

Additional flushes of material recirculation lines 60 and 70 may occur. For example, upon depletion of tank 30 of the second material, a third material may be added to the tank. Alternatively, tank 30 may be replaced with another tank (not shown) containing a third material. Similarly, tanks to supply the second and/or third materials may be replaced with a source of gas. Operation of valves 32, 34, 36, 38 and flow paths for the third material and/or the gas are similar to those described for the second material.

During operation of material delivery system 100, the tool is primarily supplied by one material recirculation line (e.g. 60 or 70), which is supplied by two sources of material (e.g. 10 or 20), sequentially or at the same time. However, during the transition between material recirculation lines (e.g. 60, 70) and/or between sources of material (e.g. 10, 20), the tool may be simultaneously supplied by both recirculation lines (e.g. 60 and 70) and/or both sources of material (e.g. 10 and 20).

One method of operation of material delivery system 100 will now be described in a series of sequential steps. For the purposes of this description various modes of operation are denoted as sequences. It is understood that in a continuous operation each sequence may occur one or more times and, although one sequence is denoted as a first sequence, any sequence in the series may be regarded as the first sequence.

In a first sequence, material is supplied to the tool from tank 20 through the first material recirculation line 60 via open valves 22 and 24. Tank 10 contains material and is locally recirculating though open valve 50 until it is brought on line. All other valves are closed.

When the amount of material in tank 20 drops to a low level in a second sequence, valve 24 is closed so that the portion of material from tank 20 not used by the tool is no longer recirculated from material recirculation line 60 back to tank 20. Valves 12 and 14 are opened and valve 50 is closed so that material in tank 10 passes through material recirculation line 60 and the portion of material not used by the tool is returned to tank 10. Similarly the portion of the material from tank 20 not used by the tool is sent to tank 10.

When the material in tank 20 is substantially exhausted in a third sequence, valve 22 is closed and valve 40 is opened fluidly isolating tank 20 from material recirculation line 60. A fourth material is then introduced into tank 20 to flush and/or clean the tank prior to preparing a new batch of material for delivery to the tool. The fourth material may be any solvent, chemical or gas suitable to flush and/or clean tank 20 and tank recirculation line 80. As with the third material described above, the fourth material may be deionized water, KOH, or gas. In one embodiment in which the tank mixes and/or holds a slurry, the fourth material may be deionized water. The fourth material may be returned to tank 20 for subsequent draining, or diverted directly to a drain (not shown). Valves 12 and 14 remain open to pass material from tank 10 through material recirculation line 60. The portion of material not used by the tool is returned to tank 10. A flush of material recirculating line 70 may be initiated during the third sequence, in which valves 36 and 38 are opened to pass a second material such as deionized water through material recirculation line 70. Deionized water exiting material recirculation line 70 may be returned to tank 30 for subsequent draining, or alternatively sent directly to drain (not shown). All other valves remain closed. It is understood that initiation of a flushing sequence need not occur during the third sequence, but may begin in an earlier or later sequence as long as the material recirculation line to be flushed is out-of-service and sufficient time is available to complete the flush prior to bringing the out-of-service line into service.

After passing deionized water through material recirculation line 70, in a fourth sequence, tank 30 may be filled with KOH or may be replaced with tank 30*a* (not shown) containing KOH. Valves 36 and 38 remain open to pass KOH from tank 30 to material recirculation line 70. Valves 12 and 14 remain open to pass material from tank 10 through material recirculation line 60. Any portion of material not used by the tool is returned to tank 10. Valve 40 remains open as tank 20 is drained for preparation of making the material for delivery to the tool. All other valves remain closed.

When the material in tank 10 drops to a low level, constituents of the material to be provided to the tool are introduced to tank 20 for mixing and subsequent recirculation in a fifth sequence. Alternatively, premixed material may be directly added to tank 20 for recirculation. Tank 20 locally recirculates material through open valve 40. Material passes though material recirculation line 60 from tank 10 via open valves 12 and 14. KOH continues to pass through material recirculation line 70 through open valves 36 and 38. All other valves remain closed.

When the material in tank 10 is sufficiently low in a sixth sequence, valve 14 is closed preventing any portion of the material not used by the tool from returning to tank 10. Valves 22 and 24 are opened and valve 40 is closed causing material from tank 20 to pass through material recirculation line 60. Any portion of material not used by the tool is returned to tank 20. Any portion of the material from tank 10 not used by the tool is sent to tank 20. KOH continues to pass through material recirculation line 70 via open valves 36 and 38. All other valves remain closed.

When the material in tank 10 is substantially low or exhausted in a seventh sequence, valve 12 is closed and valve 50 is opened isolating tank 10 from material recirculation line 60. The fourth material, such as deionized water is added to tank 10 to flush and/or clean the tank prior to preparing a new batch of material for the tool. The fourth material may be returned to tank 10 for subsequent draining, or diverted directly to a drain (not shown). Material is provided to the tool through material recircualation line 60 from tank 20 via open valves 22 and 24. KOH continues to pass through material recirculation line 70 via open valves 36 and 38. All other valves remain closed.

After passing KOH through material recirculation line 70, tank 30 may be filled with deionized water or may be replaced with tank 30*b* (not shown) containing deionized water in an eighth sequence. Deionized water passes through material recirculation line 70 via open valves 36 and 38 and may return to tank 30*b* for subsequent draining or sent directly to a drain (not shown). Valve 50 remains open as tank 10 is drained to begin preparing material for delivery to the tool. Material is provided to the tool from tank 20 via open valves 22 and 24. Any portion of material not used by the tool is returned to tank 20. All other valves remain closed.

After the second flush with deionized water through material recirculation line 70, tank 30 may be replaced with a source of gas, such as nitrogen in a ninth sequence. Nitrogen is passed through material recirculation line 70 via open valves 36 and 38 for subsequent discharge from the line. Constituents of the material to be provided to the tool are introduced to tank 10 for mixing and subsequent recirculation. Alternatively, premixed material may be directly added to tank 10 for recirculation. Tank 10 locally recirculates material through open valve 50. Material continues to pass though material recirculation line 60 from tank 20 via open valves 22 and 24. All other valves remain closed.

After flushing material recirculation line 70 with nitrogen, valves 36 and 38 are closed to isolate material recirculation line 70 in a tenth sequence. Tank 10 locally recirculates material through open valve 50. Material continues to pass though material recirculation line 60 from tank 20 via open valves 22 and 24. All other valves remain closed.

In an eleventh sequence, valves 16 and 18 are opened and valve 50 is closed thereby charging material recirculation line 70 with material from tank 10 allowing material recirculation line 70 to be brought up to system pressure prior to delivering material to the tool. All material in material recirculation line 70 is returned to tank 10. Material continues to pass to the tool through material recirculation line 60 from tank 20 via open valves 22 and 24. Any portion of material not used by the tool is returned from material recirculation line 60 to tank 20. All other valves remain closed.

In a twelfth sequence, valves 16 and 18 remain open as material passes through material recirculation line 70 for use by the tool. The tool may be the same tool that is fluidly connected to material recirculation line 60. Any portion of material not used by the tool is returned from material recirculation line 70 to tank 10. Material continues to pass through material recirculation line 60 from tank 20 via open valves 22 and 24. Any portion of material not used by the tool is returned from material recirculation line 60 to tank 20. All other valves remain closed.

When the material in tank 20 is substantially exhausted in a thirteenth sequence, valves 22 and 24 are closed and valve 40 is opened isolating tank 20 from material recirculation line 60. The fourth material, such as deionized water, is then introduced into tank 20 to flush and/or clean the tank prior to preparing a new batch of material for the tool. The fourth material may be retuned returned to tank 20 for subsequent draining, or diverted directly to a drain (not shown). Valves 16 and 18 remain open to pass material from tank 10 through material recirculation line 70. The portion of material not used by the tool is returned to tank 10. A flush of material recirculating line 60 may be initiated during this sequence, in which valves 32 and 34 are opened passing deionized water through material recirculation line 60. Deionized water exiting material recirculation line 60 may be returned to tank 30 for subsequent draining, or alternatively sent directly to drain (not shown). All other valves remain closed.

After passing deionized water through material recirculation line 60, in a fourteenth sequence, tank 30 may be filled with KOH or may be replaced with tank 30*a* (not shown) containing KOH. Valves 32 and 34 remain open to pass KOH from tank 30 to material recirculation line 60. Valves 16 and 18 remain open to pass material from tank 10 through material recirculation line 70. Any portion of material not used by the tool is returned to tank 10. Valve 40 remains open as tank 20 is drained to prepare another batch of material for delivery to the tool. All other valves remain closed.

When the material in tank 10 drops to a low level, constituents of the material to be provided to the tool are introduced to tank 20 for mixing and subsequent recirculation in a fifteenth sequence. Alternatively, premixed material may be directly added to tank 20 for recirculation. Tank 20 locally recirculates through open valve 40. Material passes though material recirculation line 70 from tank 10 via open valves 16 and 18. KOH continues to pass through material recirculation line 60 through open valves 32 and 34. All other valves remain closed.

After passing KOH through material recirculation line 60, tank 30 may be filled with deionized water or may be replaced with tank 30*b* (not shown) containing deionized water in a sixteenth sequence. Deionized water passes through material recirculation line 60 via open valves 32 and 34 and may return to tank 30*b* for subsequent draining or sent directly to a drain (not shown). Tank 20 locally recirculates through open valve 40. Material passes though material recirculation line 70 from tank 10 via open valves 16 and 18. All other valves remain closed.

When the material in tank 10 is sufficiently low, in a seventeenth sequence valve 18 is closed preventing any portion of the material not used by the tool from returning to tank 10. Valves 26 and 28 are opened and valve 40 is closed causing material from tank 20 to pass through material recirculation line 70. Any portion of material from tank 10 or 20 not used by the tool is returned to tank 20. Deionized water continues to pass through material recirculation line 60 via open valves 32 and 34. All other valves remain closed.

After the second flush with deionized water through material recirculation line 60, tank 30 may be replaced with a source of gas, such as nitrogen in an eighteenth sequence. Nitrogen is passed through material recirculation line 60 via open valves 32 and 34 for subsequent discharge from the line. Valve 50 is opened and a fourth material such as deionized water is introduced into tank 10 to flush and/or clean the tank prior to preparing a new batch of material for the tool. The fourth material may be returned to tank 10 for subsequent draining, or diverted directly to a drain (not shown). Material continues to pass though material recirculation line 60 from tank 20 via open valves 26 and 28. All other valves remain closed.

In a nineteenth sequence, valves 32 and 34 are closed isolating material recirculation line 70, which is now ready for a subsequent material recirculation line transfer. Tank 10 is drained to prepare another batch of material. Material continues to pass though material recirculation line 70 from tank 20 via open valves 26 and 28. All other valves remain closed.

The first through the nineteenth sequence may be repeated as long as the tool is in service. Time intervals for each of the sequences may vary among one another and among various iterations of the sequences.

Because the material delivery system includes two or more lines delivering material to the tool and two or more sources of material, the tool may continuously run even when the material supply lines are scheduled for flushing and/or cleaning, which often requires a longer period of time than would be provided by use of a single source of material. Because the residual material in a tank to be brought out of service is provided to the tool and cycled to a second tank, dead volume and material loss may be reduced. A cyclic transfer between two or more sources of material fluidly connected to one material recirculation line may also allow the out-of-service material recirculation line to receive a multistep flushing. This is in contrast to typical systems in which down time may occur when one source supplies one in-service supply line and a second source supplies a second out-of-service supply line, in which case, a multiflush of the out-of-service supply line may not be completed before the in-service supply line is exhausted of material.

Another advantage of switching between tank recirculation lines in which both tank recirculation lines supply a single material recirculation line may be a reduction in line pressure variations which may affect tool productivity. Recirculation of material in the out-of-service tank recirculation line may bring the source of material up to system pressure before it is fluidly connected to the system, which may reduce or eliminate drops or spikes in system pressure. Similarly, charging an out-of-service material recirculation line while the in-service material recirculation line provides material to the tool may reduce or eliminate drops or spikes in system pressure when the out-of service material recirculation system is brought on line.

The disclosed methods of providing materials may be performed manually or implemented automatically through use of a controller incorporated into the system. For example, the system may include a controller in communication with the sensors and various valves associated with flow to process lines and tools.

Figure 2:
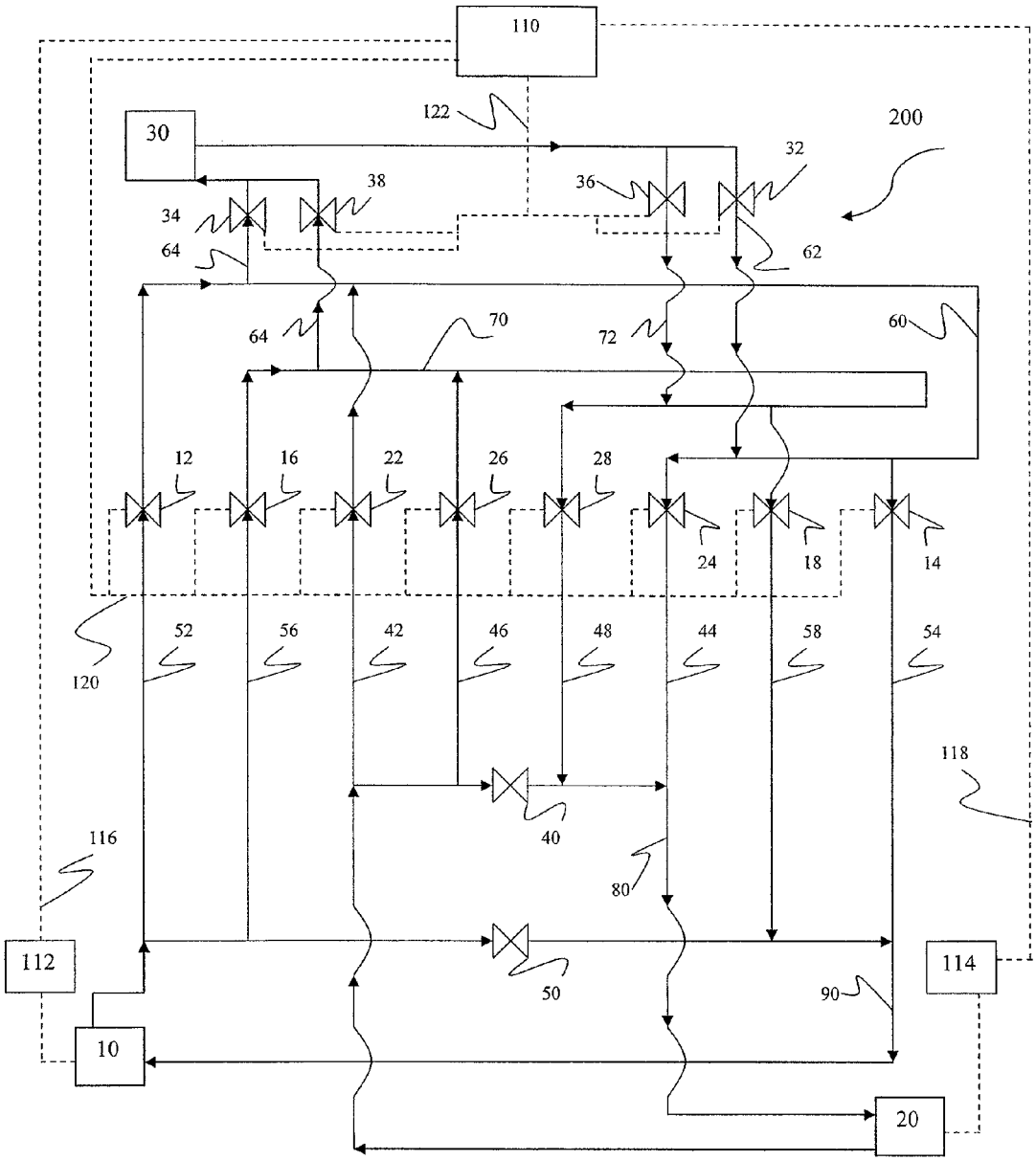
FIG. 2 is a schematic diagram illustrating a system in accordance with another embodiment of the present invention.

FIG. 2 illustrates another embodiment to the invention in which a controller 110 is added to the material delivery system in FIG. 1. As seen in FIG. 2, material delivery system 200 includes first and second sources of material 10, 20 as well as a source of a second material 30. Valves and lines are identical to those shown in FIG. 1, and are represented with identical reference numerals.

In FIG. 2, sensor 112, 114 is disposed in tank 10 and sensor 114 is disposed in tank 20. It is understood that based upon the sensor used, sensor 112, 114 need not be placed in tanks 10 and 20 to detect the amount of material remaining in the tanks. Sensor signal lines 116 and 118 provide sensor input to controller 110 from sensors 112, 114, respectively. Controller 110 may be configured to control valves 12, 14, 16, 18, 22, 24, 26, 28 via line 120 according to any or all of the first through the nineteenth sequences described above. Line 120 is denoted as a single line for ease of representation, however, it is understood that line 120 may be a single line, multiple lines, a bus network, and combinations thereof. Controller 110 may also be configured to control valves 32, 34, 36, 38 via line 122 according to any or all of the first through the nineteenth sequences described above. Sensors 112, 114 may be liquid level sensors detecting when the amount of material in tanks 10, 20 is below a desired level, thereby causing the controller to initiate valve operation to transfer primary material supply from one tank to another. Sequencing of valve operation of material delivery system 200 is identical to that of material delivery system 100.

In another embodiment, additional sensors (not shown) may be positioned in tanks 10, 20 of material delivery system 200 to provide a second low level indication of the amount of material in tanks 10, 20 which may be less than a first low level indication. As previously noted, some level sensors need not be positioned in the tank. For example, a low level sensor and a low-low level sensor may be positioned in each tank. Once the low level sensor detects a predetermined amount of material remaining in tank 10, a signal may be provided to the controller 110 to bring tank 20 on line, while tank 10 continues to dispense material. The controller 110 may be configured to open and closes valves as in the sixth sequence discussed above. Once the low-low level senor detects a second predetermined amount of material remaining in tank 10, a signal may be provided to the controller 110 to isolate tank 10 as in the seventh sequence discussed above.

The controller may be implemented using one or more computer systems, for example, a general-purpose computer such as those based on an Intel PENTIUM®-type processor, a Motorola PowerPC® processor, a Sun UltraSPARC® processor, a Hewlett-Packard PA-RISC® processor, or any other type of processor or combinations thereof. Alternatively, the computer system may include specially-programmed, special-purpose hardware, for example, an application-specific integrated circuit (ASIC) or controllers intended for material processing systems.

The computer system may include one or more processors typically connected to one or more memory devices, which can comprise, for example, any one or more of a disk drive memory, a flash memory device, a RAM memory device, or other device for storing data. The memory is typically used for storing programs and data during operation of a material processing system and/or the computer system. For example, the memory may be used for storing historical data relating to parameters over a period of time, as well as operating data. Software, including programming code that implements embodiments of the invention, can be stored on a computer readable and/or writeable nonvolatile recording medium, and then typically copied into the memory wherein it can then be executed by the processor. Such programming code may be written in any of a plurality of programming languages, for example, Java, Visual Basic, C, C#, or C++, Fortran, Pascal, Eiffel, Basic, COBAL, or any of a variety of combinations thereof.

Components of the computer system may be coupled by one or more interconnection mechanisms, which may include one or more busses (e.g., between components that are integrated within a same device) and/or a network (e.g., between components that reside on separate discrete devices). The interconnection mechanism typically enables communications (e.g., data, instructions) to be exchanged between components of the computer system.

The computer system can also include one or more input devices, for example, a keyboard, mouse, trackball, microphone, touch screen, and other man-machine interface devices as well as one or more output devices, for example, a printing device, display screen, or loudspeaker. In addition, the computer system may contain one or more interfaces (not shown) that can connect the computer system to a communication network (in addition or as an alternative to the network that may be formed by one or more of the components of the computer system).

According to one or more embodiments of the invention, the one or more input devices may include sensors for measuring parameters of a material processing system and/or components thereof. Alternatively, the sensors, the metering valves and/or other components, may be connected to a communication network that is operatively coupled to the computer system. Any one or more of the above may be coupled to another computer system or component to communicate with the computer system over one or more communication networks. Such a configuration permits any sensor or signal-generating device to be located at a significant distance from the computer system and/or allow any sensor to be located at a significant distance from any subsystem and/or the controller, while still providing data therebetween. Such communication mechanisms may be effected by utilizing any suitable technique including, but not limited to, those utilizing wireless protocols.

The controller can include one or more computer storage media such as readable and/or writeable nonvolatile recording medium in which signals can be stored that define a program to be executed by one or more processors. The medium may, for example, be a disk or flash memory. In typical operation, the processor can cause data, such as code that implements one or more embodiments of the invention, to be read from the storage medium into a memory that allows for faster access to the information by the one or more processors than does the medium. The memory is typically a volatile, random access memory such as a dynamic random access memory (DRAM) or static memory (SRAM) or other suitable devices that facilitates information transfer to and from the processor.

It should be appreciated that the invention is not limited to being implemented in software, or on the computer system as exemplarily discussed herein. Indeed, rather than implemented on, for example, a general purpose computer system, the controller, or components or subsections thereof, may alternatively be implemented as a dedicated system or as a dedicated programmable logic controller (PLC) or in a distributed control system. Further, it should be appreciated that one or more features or aspects of the invention may be implemented in software, hardware or firmware, or any combination thereof. For example, one or more segments of an algorithm executable by controller can be performed in separate computers, which in turn, can be communicated through one or more networks.

Other embodiments of the systems and methods of the present invention are envisioned beyond those exemplarily described herein.

Having thus described several aspects of at least one embodiment of this invention, it is to be appreciated various alterations, modifications, and improvements will readily occur to those skilled in the art. Such alterations, modifications, and improvements are intended to be part of this disclosure, and are intended to be within the spirit and scope of the invention. Accordingly, the foregoing description and drawings are by way of example only.

What is claimed is:

1. A method of providing a material to a semiconductor tool comprising:

providing a first source of a material fluidly connected via an inlet and an outlet to a first recirculating material supply line, said first recirculating material supply line fluidly connected to a tool;

passing material from the first source of the material through the first recirculating material supply line so that a first portion of the material is delivered to the tool and the remaining portion of the material is returned to the first source;

providing a second source of the material fluidly connected to a recirculation line and passing material from the second source of the material through the recirculation line and back to the second source, said second source of the material also fluidly connected via an inlet and an outlet to a second recirculating material supply line, and said second recirculating material supply line fluidly connected to the tool; and changing the source of the material supplied to the tool by interrupting the flow from the second source through the recirculation line and passing the material from the second source through the second recirculating material supply line so that a first portion of the material is delivered to the tool and the remaining portion of the material is returned to the second source;

interrupting the flow through the portion of the first recirculating material supply line returning the material to the first source and passing any remaining portion of material through the first recirculating material supply line to the second source; and once a desired portion of the material has been emptied from the first source, interrupting the flow from the first source through the portion of the first recirculating material supply line connected to the tool so that all of the material delivered to the tool is from the second source.

2. The method of claim 1 further comprising purging the first recirculating material supply line after the portion of the first recirculating material supply line connected to the tool has been closed.

3. The method of claim 2 further comprising:

providing a recirculation line fluidly connected to the first source of a material;

after the first recirculating material supply line has been purged, adding material to the first source of a material and passing material from the first source of material through the recirculation line and back to the first source; and changing the source of the material supplied to the tool by closing the recirculation line connected to the first source of a material and passing material from the first source through the first recirculating material supply line so that a first portion of the material is delivered to the tool and the remaining portion of the material is returned to the first source;

closing the portion of the second recirculating material supply line returning the material to the second source and passing any remaining portion of material through the first recirculating material supply line to the first source; and once a desired portion of the material has been emptied from the second source, closing the portion of the second recirculating material supply line connected to the tool so that all of the material delivered to the tool is from the first source.

4. The method of claim 3 further comprising purging the second recirculating material supply line after the portion of the second recirculating material supply line connected to the tool has been closed.

5. The method of claim 4 further comprising after the second recirculating material supply line has been purged, adding material to the second source of a material and passing material from the second source of material through the recirculation line connected to the second source and back to the second source.

6. The method of claim 4 further comprising providing a source of a purging material fluidly connected to the second recirculating material supply line and in which purging the second recirculating material supply line comprises isolating a portion of the second material supply line from the tool and from the second source of a material and passing a purging material through the isolated portion of the second recirculating material supply line.

7. The method of claim 2 further comprising providing a source of a purging material fluidly connected to the first recirculating material supply line and in which purging the first recirculating material supply line comprises isolating a portion of the first material supply line from the tool and from the first source of a material and passing a purging material through the isolated portion of the first recirculating material supply line.

8. The method of claim 7 in which the purging material comprises deionized water, KOH, or gas.

9. The method of claim 7 in which passing a purging material through the isolated portion of the first recirculating material supply line comprises passing a plurality of different purging materials material through the isolated portion of the first recirculating material supply line.

* * * * *